US008621800B2

(12) United States Patent
Keene

(10) Patent No.: US 8,621,800 B2
(45) Date of Patent: Jan. 7, 2014

(54) MORTAR AND DEBRIS COLLECTION SYSTEM FOR MASONRY CAVITY WALLS

(75) Inventor: James R. Keene, Pepper Pike, OH (US)

(73) Assignee: Keene Building Products Co., Ltd., Mayfield Heights, OH (US)

( * ) Notice: Subject to any disclaimer, the term of this patent is extended or adjusted under 35 U.S.C. 154(b) by 251 days.

(21) Appl. No.: 13/099,423

(22) Filed: May 3, 2011

(65) Prior Publication Data

US 2012/0279153 A1 Nov. 8, 2012

(51) Int. Cl.
*E04B 2/28* (2006.01)
*E04F 17/00* (2006.01)
*E02D 19/00* (2006.01)

(52) U.S. Cl.
USPC ..... 52/302.4; 52/302.1; 52/169.5

(58) Field of Classification Search
USPC ..... 52/169.5, 302.1, 302.3, 302.4; 210/508
See application file for complete search history.

(56) References Cited

U.S. PATENT DOCUMENTS 3,374,589 A * 3/1968 Neal, Jr. ..... 52/105
4,375,143 A * 3/1983 Godlewski ..... 52/98
5,230,189 A 7/1993 Sourlis
5,343,661 A 9/1994 Sourlis
5,937,594 A 8/1999 Sourlis
6,023,892 A 2/2000 Sourlis
RE36,676 E * 5/2000 Sourlis ..... 52/169.5
6,112,476 A * 9/2000 Schulenburg ..... 52/169.5
6,256,955 B1 7/2001 Lolley et al.
6,684,579 B2 2/2004 Brunson et al.
6,912,820 B2 7/2005 Sourlis
7,216,460 B2 5/2007 Sourlis
7,386,956 B2 * 6/2008 Argila ..... 52/169.5
7,421,826 B2 * 9/2008 Collins et al. ..... 52/302.1
7,448,175 B2 11/2008 Sourlis
7,526,900 B2 5/2009 Ehrman et al.
7,543,413 B2 6/2009 Sourlis
7,543,414 B2 6/2009 Sourlis
7,726,084 B2 6/2010 Sourlis
7,730,684 B1 6/2010 Keene
7,730,685 B1 6/2010 Keene
7,810,292 B2 10/2010 Ehrman et al.
8,061,090 B2 * 11/2011 Sourlis ..... 52/169.5
2009/0158675 A1 * 6/2009 Sourlis ..... 52/101
2011/0107700 A1 * 5/2011 Keene ..... 52/403.1
2011/0302863 A1 * 12/2011 Sourlis ..... 52/302.1
2012/0183744 A1 * 7/2012 Keene ..... 428/175

FOREIGN PATENT DOCUMENTS

WO 03/089726 A2 * 10/2003

* cited by examiner

*Primary Examiner* — Robert Canfield
(74) *Attorney, Agent, or Firm* — Renner, Otto, Boisselle & Sklar, LLP

(57) ABSTRACT

A mortar and debris collection device for use in a masonry wall assembly includes a water permeable body made of an open-space defining array of polymer filaments that twist and turn between filament intersections where adjacent filaments are bonded to each other. The water permeable body comprises a shell having a hollow interior and includes an elongated base and extensions upwardly projecting from the base.

31 Claims, 11 Drawing Sheets

MORTAR AND DEBRIS COLLECTION SYSTEM FOR MASONRY CAVITY WALLS

TECHNICAL FIELD

The present invention relates to the construction of masonry "cavity" walls of the type that have an outer wall structure formed from masonry components set in mortar, and an inner wall structure that is separated from the outer wall structure by an air space cavity from which moisture is vented by weep vent passages formed through lower portions of the outer wall structure. More particularly, the present invention relates to the provision and use of a debris collection device for insertion into lower portions of the air space cavity of masonry cavity walls, the debris collection device providing improved drainage and air circulation while preventing the obstruction of drainage weep vent passages by wet and dry mortar droppings and sizable construction debris during and after construction.

BACKGROUND

So-called "masonry cavity walls" have outer wall structures formed from masonry elements such as bricks, concrete blocks, tiles, stones and the like that are set in mortar, and inner wall structures that are separated from the outer wall structures by a space of typically about one to about five inches. The space between the inner and outer wall structures is referred to as an "air space cavity" or, more simply, as a "cavity." If the space between the inner and outer wall structures of a masonry cavity wall is two inches, the air space cavity is said to have a "width" of two inches. Masonry cavity walls typically have cavities that range in width from about one inch to about five inches, with a range of about one inch to about three inches being most common.

As is well known, moisture tends to form in the air space cavity of a masonry cavity wall, and tends to collect in lowermost portions of the cavity. If collected moisture is allowed to remain within the air space cavity, damage may be caused as adjacent and nearby construction materials become damp. This damage may range from cosmetic discoloration to rot, disintegration and structural weakening that may require costly repair and replacement.

Providing weep vent passages that extend through the outer wall structure, especially through lowermost portions of the outer wall structure, can do much to ventilate and to drain moisture from the air space cavity of a masonry wall. However, weep vent passages will not perform their intended function if they are obstructed, or if moisture is blocked from moving through lower and lowermost portions of the air space cavity to reach the weep vent passages.

To prevent mortar and construction debris from collecting in lowermost portions of masonry wall cavities where it may obstruct or block moisture from entering and discharging through weep vent passages intended to drain moisture from lowermost cavity portions, a variety of types of collectors and deflectors have been proposed for insertion into air space cavities.

SUMMARY

In a first aspect of the invention, there is provided a mortar and debris collection device for use in a masonry wall assembly having an inner wall and an outer wall, a masonry cavity defined between the walls, and weep vent passages formed through the outer wall, where the weep vent passages open into the cavity for discharge of moisture from the cavity. The device includes a water permeable body that includes a contoured shell formed of an open space array of polymer filaments that twist and turn between filament intersections where adjacent ones of the filaments are bonded to each other, the contours of the shell defining an interior filament-free hollow. The shell has a base elongated along a long axis and at least one extension upwardly projecting from the base along the linear axis in a vertical direction. The at least one extension includes at least one shelf for collecting mortar and debris within the masonry cavity above the weep vent passages.

In one embodiment, the shell includes two or more extensions upwardly projecting from the base.

The extension may further include at least two shelves for collecting mortar and debris.

In one embodiment, the at least one extension includes a frame having a central cut-out.

In one embodiment, the at least one extension has an upper edge and includes a plurality of alternating valleys and ridges extending lengthwise to the upper edge. The ridges and valleys may extend from the base to the upper edge. Alternatively, the ridges and valleys may extend from a midway point along the length of the extension to the upper edge. The ridges may have a planar surface or a dome-shaped surface. The extensions may have a combination of planar ridges and dome-shaped ridges.

The base of the shell may include a lower shelf for collecting mortar and debris, so that the shell has multiple levels for collecting mortar and debris.

In one embodiment, the at least one extension further includes a notch having an opening at the uppermost edge and a notch base, the notch base forming an intermediate shelf for collecting mortar and debris.

In one embodiment, the at least one extension has a keystone shape. The shell may include two or more extensions with adjacent extensions forming a trapezoidal shaped channel therebetween. The keystone shaped extensions may be configured so as to be positionable between the keystone shaped extensions of a second mortar and debris collection device to permit rolling of the device together with the second mortar and debris collection device. The device may also be stackable with one or more additional mortar and debris collection devices to facilitate transport of the devices.

In one embodiment, the shell further includes a planar periphery rim for bonding a fabric layer to the shell. The width of the rim may be in the range from about 0.25 inch to about 5.0 inches.

In one embodiment, the at least one extension further includes an identifying element.

In one embodiment, the device has a vertical edge and the vertical edge includes an engaging member for coupling the device to an adjacent mortar and debris collection device within the masonry cavity.

In one embodiment, the body has a maximum thickness dimension substantially the same as the width of the masonry cavity.

The quantity or thickness of the polymer filaments of the base may be greater than the quantity of thickness of the polymer filaments of the at least one extension. Alternatively, the quantity or thickness of the polymer filaments of the at least one extension may be greater than the quantity of thickness of the polymer filaments of the base.

In one embodiment, the total thickness of the at least one shelf and any additional shelves, if present, within the at least one extension is between about 0.01 to about 0.5 inch.

In one embodiment, the total volume of filaments in the at least one extension is less than 10% based on the total volume of filaments and filament-free space occupied by the extension within the masonry cavity. In one embodiment, the total volume of filaments in the at least one extension is less than 5%, or less than 3% based on the total volume of filaments and filament-free space occupied by the extension within the masonry cavity.

The polymer filaments of the shell may be made of a material selected from polyolefin, polyamide, polyester, polyvinylhalide, polystyrene, polyvinylester and a mixture of two or more thereof. In one embodiment, the polymer filaments are made of a material selected from polyethylene, polypropylene, and a mixture thereof.

In one embodiment, the water permeable body further includes a fabric layer bonded to the shell. The fabric layer may include a plurality of fiberglass strands.

In one embodiment, the filament free hollow is directly below the shelf of the at least one extension.

In another aspect of the invention, there is provided a mortar and debris collection device insertable into lower portions of a cavity defined between outer and inner wall structures of a masonry cavity wall to form a multilevel collector for catching mortar droppings and sizable construction debris at locations spaced apart from where weep vent passages formed through the outer wall structure open into lowermost portions of the cavity. The device includes a water permeable body that includes a contoured shell formed of an open space array of polymer filaments that twist and turn between filament intersections where adjacent ones of the filaments are bonded to each other, the contours of the shell defining an interior filament-free hollow. The shell has a base elongated along a long axis and at least one extension upwardly projecting from the base along the linear axis in a vertical direction, the at least one extension including at least one shelf for collecting mortar and debris within the masonry cavity above the weep vent passages. The body permits moisture to pass therethrough as moisture migrates downwardly through the cavity and into the weep vent passages.

BRIEF DESCRIPTION OF THE DRAWINGS

In the annexed drawings, like parts and features have like references. The drawings are schematic illustrations which may not necessarily be drawn to scale.

DETAILED DESCRIPTION

All numerical ranges disclosed in the specification and claims may be combined in any manner. It is to be understood that unless specifically stated otherwise, references to "a," "an," and/or "the" may include one or more than one, and that reference to an item in the singular may also include the item in the plural. All combinations specified in the claims may be combined in any manner.

Figure 1:
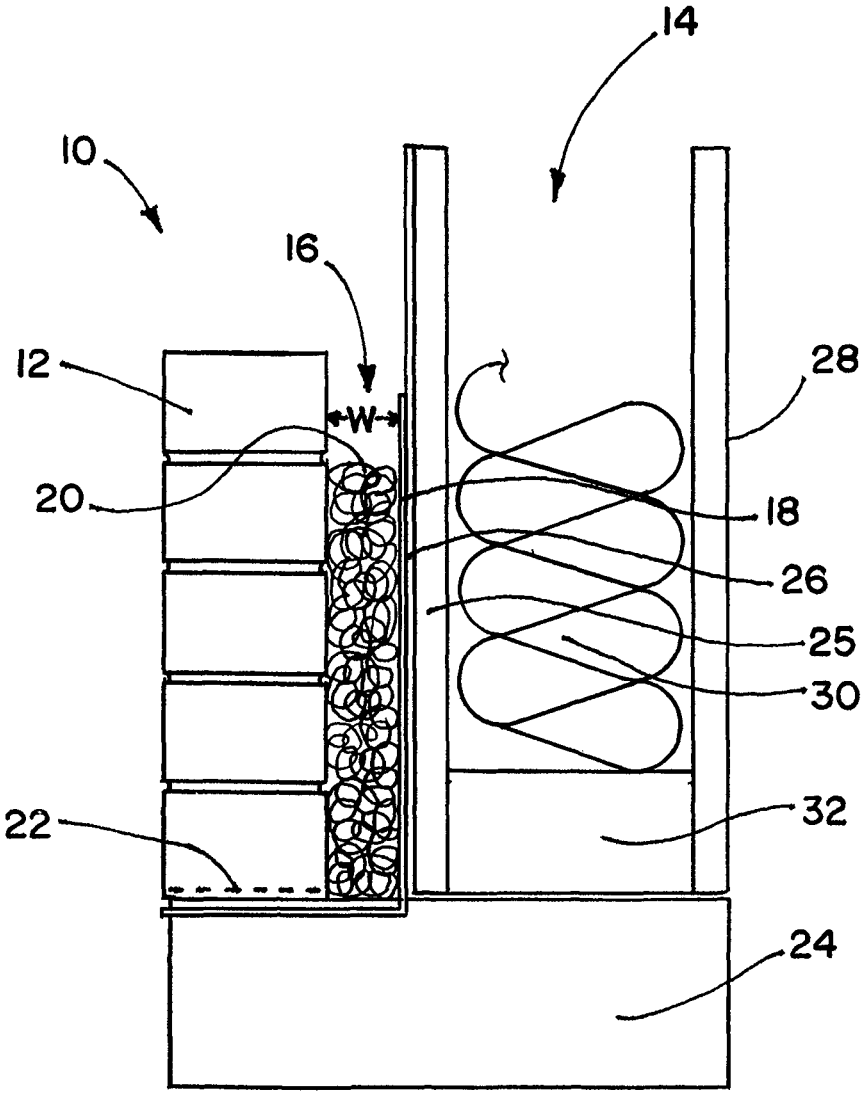
FIG. 1 is cross-sectional view of a masonry wall assembly including an embodiment of the mortar collection device of the present invention positioned within a cavity between an outer wall and an inner wall.

Referring to FIG. 1, a masonry wall assembly 10 of a building includes an outer wall 12, an inner wall 14, and a cavity 16 between the outer wall 12 and the inner wall 14 situated atop foundation 24. The width "W" of the cavity is often between about one inch (2.5 cm) and about three inches (7.6 cm), but may be as narrow as about one inch or as wide as about five inches (12.7 cm). Mortar collection device 20 is positioned within the cavity 16. The outer wall structure 12 typically is constructed of brick, concrete blocks, stone or other masonry elements laid in mortar in a conventional manner. A horizontal weep vent 22 is depicted at the lowermost course of brick. Other types of weep vent passages may be provided at other locations through the outer wall structure 12, as is well known. The inner wall structure 14 typically is constructed of a wood framework (illustrated in part by a conventional two-by-four plate 32 covered on inner sides thereof by sheathing 25 and on outer sides thereof by drywall 28. Membrane flashing or metal flashing 18 may be provided to line about the lower most ten inches (25.4 cm) of the inner wall structure. The flashing 18 may also line the bottom of the wall cavity 16. Insulation 30 may be housed between the sheathing 25 and the drywall 28. A weather barrier 26 may be positioned on the sheathing 25 facing the cavity 16.

It is desirable to limit the amount of material placed within the cavity so as to maximize the air flow and moisture drainage, yet provide a sufficient barrier to falling mortar and debris that would otherwise collect near the weep vents and obstruct the discharge of moisture from the cavity. The mortar collection device of the present invention minimizes the amount of material placed within the cavity by providing a "shell" of water-permeable interconnected fibers for suspending any fallen mortar and debris.

Figure 2:
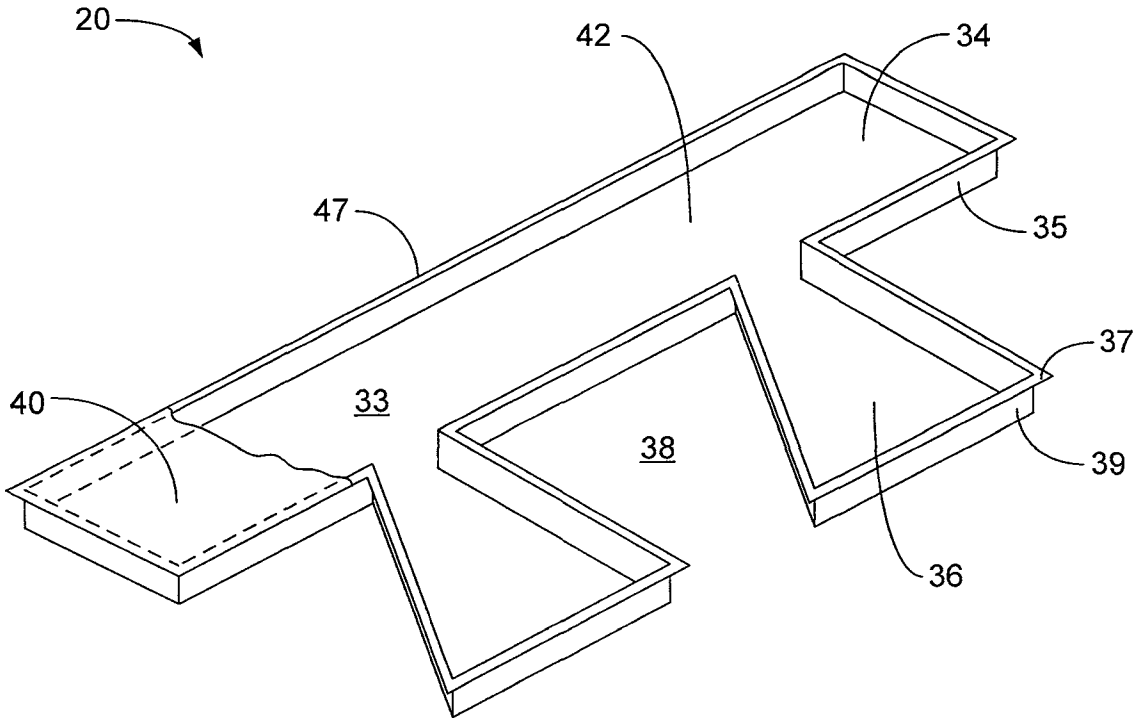
FIG. 2 is a perspective view of an embodiment of the mortar collection device of the present invention.

Referring to FIG. 2, a first embodiment of the mortar collection device 20 includes a fibrous mat 42 constructed of a thin layer of monofilaments. The fibrous mat 42 forms a shell that includes a base 34 and keystone shaped extensions 36 projecting therefrom. The base 34 and each of the extensions 36 have a hollow, filament-free interior 33. Between adjacent keystone extensions 36 are trapezoidal shaped channels 38. The mortar collection device 20 is positioned within the cavity 16 so that the base 34 is at the bottom of the cavity with the extensions 36 extending upwardly. The extensions 36 are widest at the upper end 37. At the upper end 37 of each extension 36 is formed an upper horizontal shelf for collecting and suspending fallen mortar and debris. The top of the base 34 forms a lower horizontal shelf 35 for collecting and suspending mortar and debris that may fall into channels 38 between the extensions 36.

While the extensions 36 are illustrated as having a keystone shape, the extensions 36 may be formed into other shapes. Non-limiting examples of such extension shapes include "X" shaped, "T" shaped, chevron, and crenellated. The shape of the extensions is not limited, so long as at least one "shelf" is formed to suspend the mortar and debris above the weep vents. The shape of the mortar collection device may be obtained by die-cutting a sheet of the layered fibrous mats and/or providing a substrate having the desired shape onto which the filaments are extruded.

A fabric layer 40 may be adhered to the fibrous mat 42 on the open side of the mat 42. In one embodiment, the mat 42 may include a rim 47 along the peripheral edge of the device 20, to which the fabric layer 40 may be adhered. Within the wall cavity 16, the fabric layer 40 faces the outer wall 12 and the outer surface of the fibrous mat 42 faces the inner wall 14.

Figure 3:
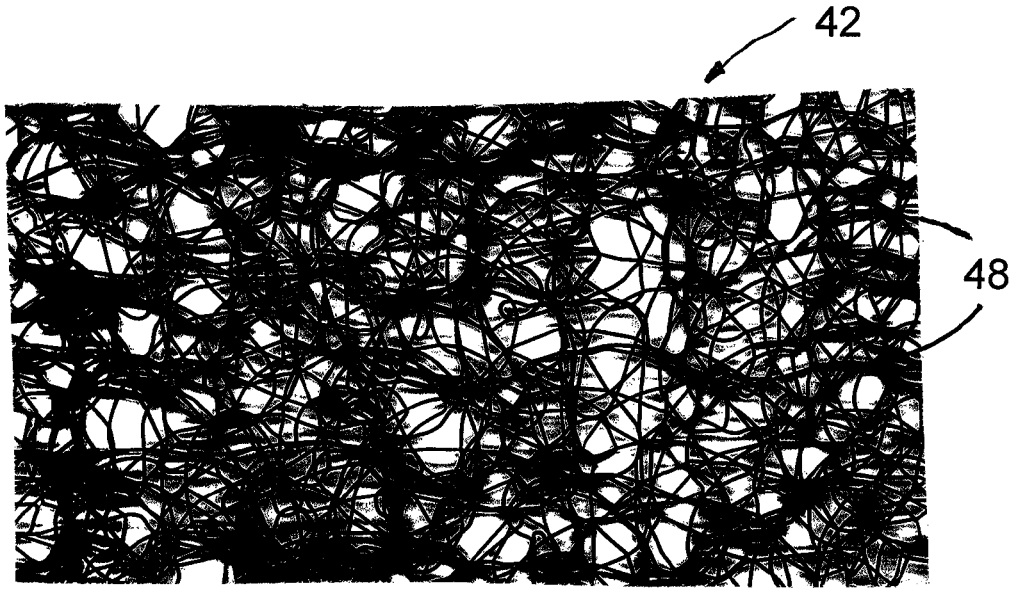
FIG. 3 is a portion of the mortar collection device formed from tangled polymer filaments.

Referring to FIG. 3, fibrous mat 42 has at least a portion thereof defined by polymer monofilaments 48 that twist and turn between junctures where adjacent filaments are connected so as to define open-space structures through which moisture can pass on its way to toward the weep vent passage openings. A contoured shell is formed from the mat by extruding the polymer monofilaments onto a substrate having the desired shape. The shell, made up of a thin layer of the randomly interesting filaments, defines an interior filament-free hollow. In one embodiment, the shell is defined substantially entirely by polymer monofilaments that twist and turn randomly between randomly located junctures where adjacent filaments are heat bonded so as to define a substantially rigid open-space shell that permits moisture to pass readily therethrough, but that catches sizable mortar droppings and construction debris and directs the droppings and debris into the channels 38 defined between the extensions 36. Only a relatively few droppings of very small size, and only particle-sized construction debris are permitted to pass through the shell itself. The polymer monofilaments 48 may have an average diameter in the range from about 1 to about 4 mils, and in one embodiment from about 2 to about 3 mils.

The fibrous mat 20 is relatively rigid and capable of supporting not only its own weight but also the loads that are imposed on the mat when a typical amount of mortar droppings and occasional pieces of construction debris fall down through the cavities of masonry cavity walls and onto the collectors. The monofilaments 48 may be made of any suitably strong and mildew resistant polymeric material, including but not limited to polyethylenes, polypropylenes and other polyolefins; polyamides; polyester, polyvinylhalide (e.g., polyvinylchloride (PVC), polyvinylidene chloride, polyvinyltetrafluoride, polyvinyl chlorotrifluoride), polystyrene, polyvinylester (e.g., polyvinyl acetate, etc.) or a mixture of two or more thereof. The monofilaments 48 may be extruded onto a substrate having the desired structural profile to form contoured mat 42.

The fabric layer 40 of the collection device 20 is preferably constructed of fiberglass or a similar material, even more preferably a material displaying resistance to environmental exposure (e.g., alkaline conditions, and the like). In one embodiment, the fabric layer 40 includes a fiberglass layer and a polymer coating. The fiberglass layer may be a woven layer. The fiberglass layer has a plurality of fiberglass strands extending parallel to one another in the machine direction, and a plurality of fiberglass strands extending parallel to one another in the cross-direction. The fiberglass strands intersect one another at angles of about 90°. The strands may be referred to as yarns. The strands may be aligned in a side-by-side configuration or in an over/under configuration. The polymer coating provides a binding to hold the strands together in the fabric layer 40.

The fiberglass strands may each comprise a plurality of fiberglass filaments. The fiberglass filaments may be combined with filaments of another material, for example, a polymer such as polyester. The average diameter of the fiberglass strands may be in the range from about 10 to about 200 mils, and in one embodiment in the range from about 20 to about 40 mils. The number of fiberglass strands extending in the machine direction may be in the range from about 1 to about 20 strands per inch of fabric layer 40 as measured in the cross-direction, and in one embodiment in the range from about 6 to about 10 strands per inch, and in one embodiment about 7 or 8 strands per inch. The number of fiberglass strands extending in the cross-direction may be in the range from about 1 to about 20 strands per inch of fabric layer 40 as measured in the machine direction 4, and in one embodiment in the range from about 6 to about 10 strands per inch of fabric layer as measured in the machine direction 4, and in one embodiment about 7 or about 8 strands per inch.

Figure 4:
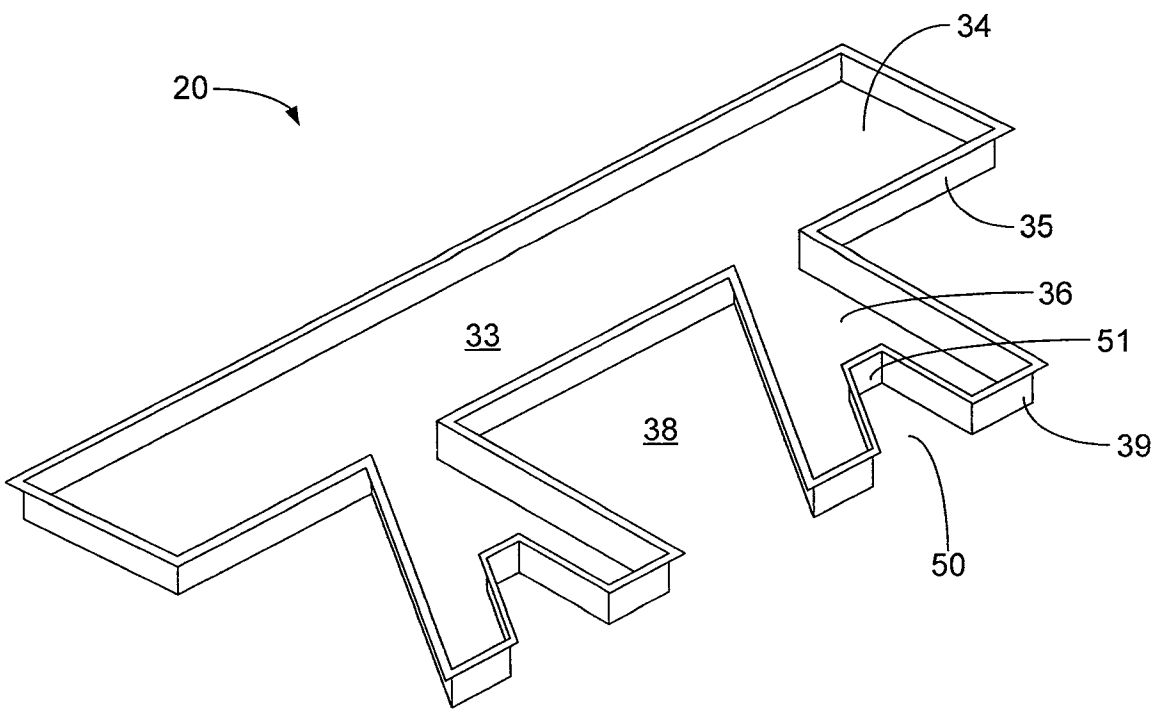
FIG. 4 is a perspective view of another embodiment of the mortar collection device of the present invention that includes a notch within the extension.

Referring to FIG. 4, another embodiment of the mortar collection device 20, similar to that shown in FIG. 2, includes extensions 36 each having a notch 50 beginning at the wide end 37 and extending toward the base 34. The base of the notch 50 forms an intermediate shelf 51 between the upper shelf 39 of the extension 36 and the lower shelf 35 of the base 34. The notches 50 allow for additional air circulation and drainage within the cavity 16, while providing a horizontal barrier for collecting falling mortar and debris and preventing blockage of the weep vents.

Figure 5:
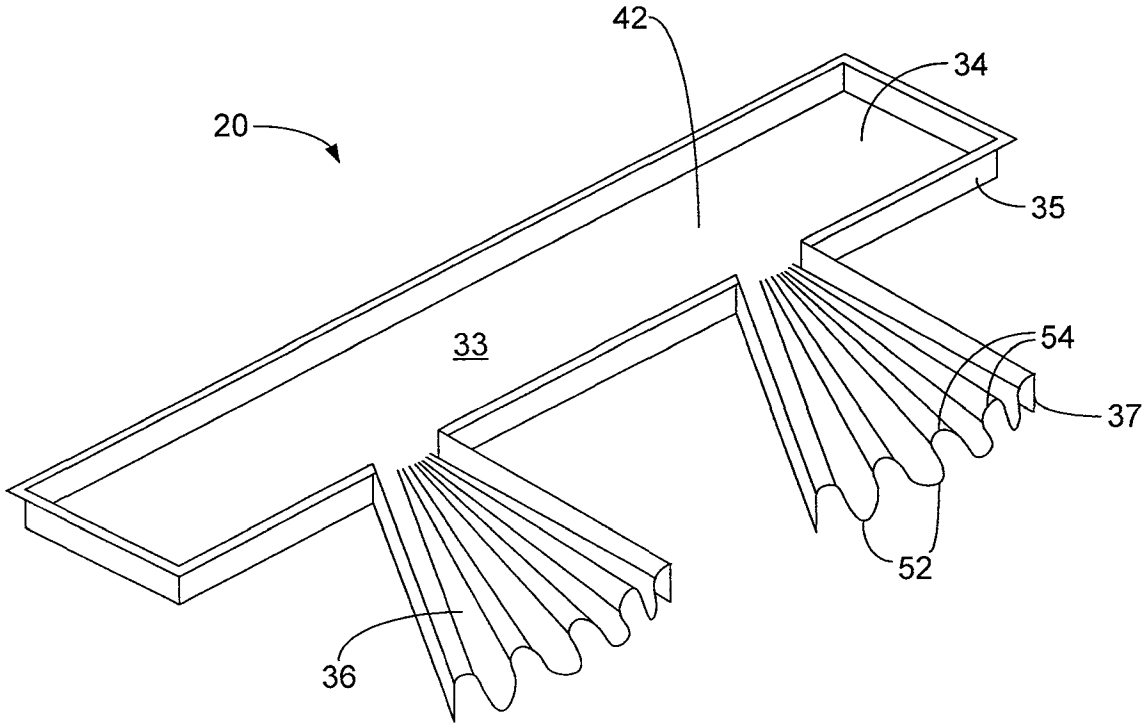
FIG. 5 is a perspective view of yet another embodiment of the mortar collection device of the present invention that includes extensions having alternating valleys and compressible ridges.
Figure 6:
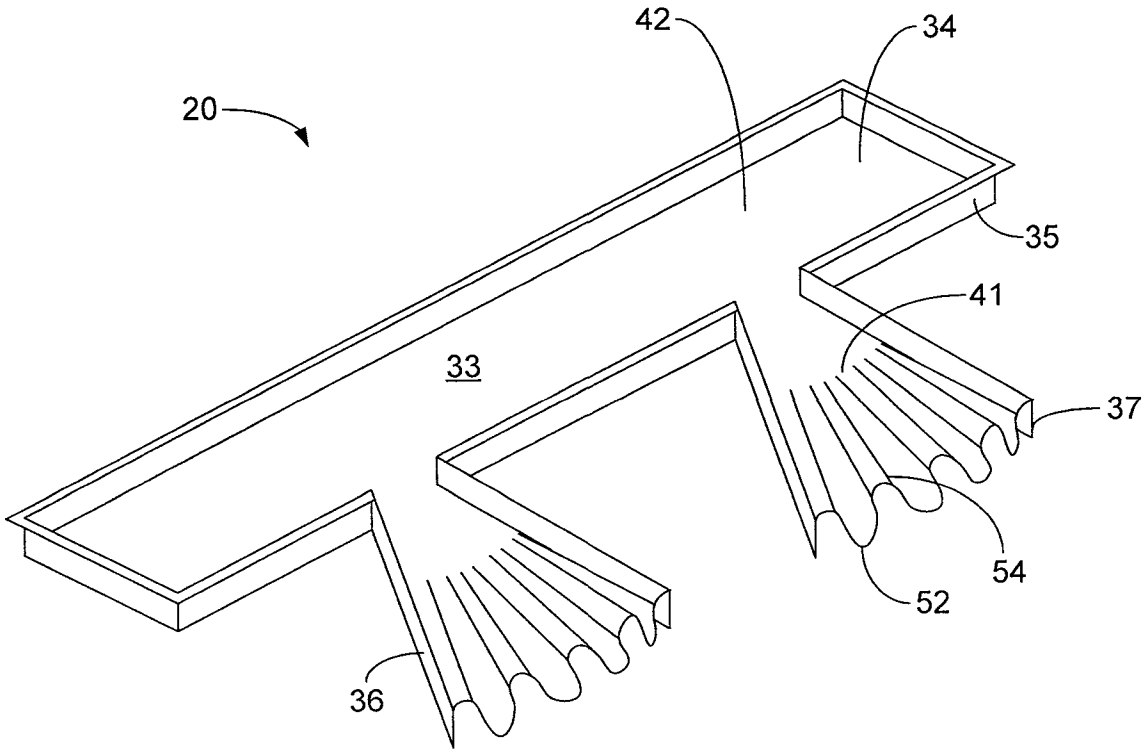
FIG. 6 is a perspective view of another embodiment of the mortar collection device of the present invention that also includes extensions having alternating valleys and compressible ridges.

Referring to FIG. 5, a further embodiment of the mortar collection device 20 includes keystone shaped extensions 36 having an undulating or wave-like profile. The mat 42 includes a plurality of extensions 36, each extension having raised ridges 52 alternating with valleys 54. The alternating ridges 52 and valleys 54 may extend the entire length of the extension 36 from the base 34 to the wide end 37 of the extension. As illustrated in FIG. 6, the alternating ridges 52 and valleys 54 may alternatively extend lengthwise from a midsection 41 of the extension 36 to the wide end 37 of the extension. In the embodiments illustrated in FIGS. 5 and 6, the spaces created between the "waves" of the ridges and valleys act as a shelf to trap and suspend mortar and debris within masonry cavity above the weep vent passages.

Figure 7A:
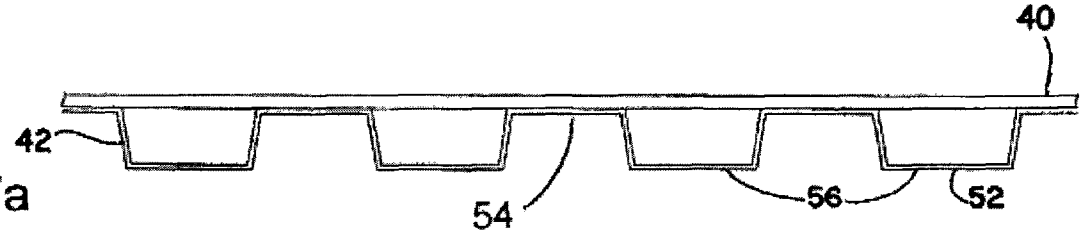
FIGS. 7A-7C are cross-sectional views of embodiments of the compressible ridges of the mortar collection device of FIGS. 5 and 6.
Figure 7B:
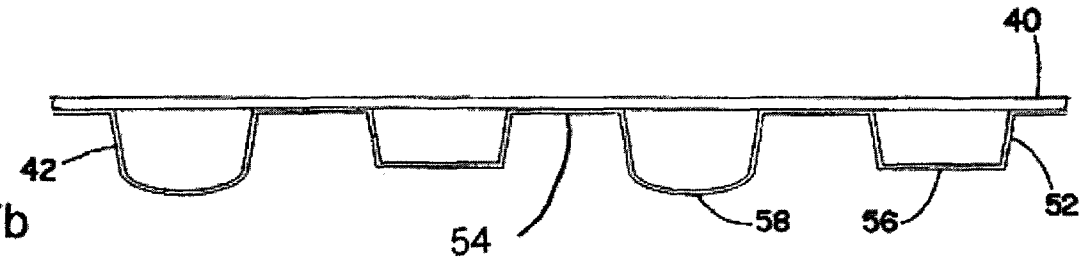
Figure 7C:
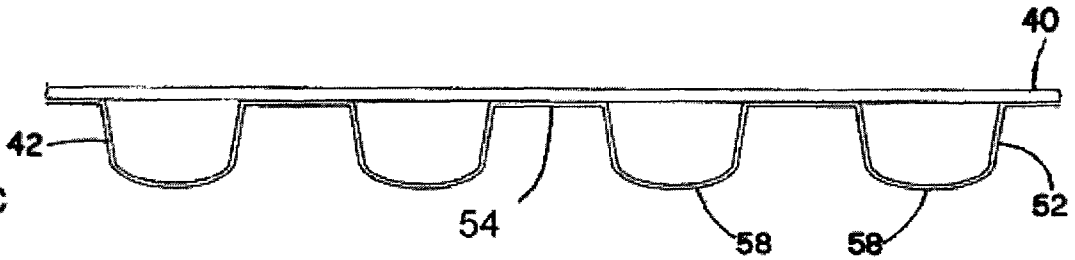

Referring to FIGS. 7A-7C, examples of various cross-sections of the extensions 36 of the embodiments of FIGS. 5 and 6 are illustrated. The outer surface of one or more of the ridges 52 may be flat. The outer surface of one or more of the ridges 52 may be convex or domed shaped. As shown in FIG. 7A, all of the ridges 52 may have a flat outer surface 56. As illustrated in FIG. 7B, ridges 52 having a flat outer surface 56 may be alternated with ridges having a domed outer surface 58. The pattern of ridges having a flat outer surface 56 and those having a domed outer surface 58 may be varied such that, for example, the ridges having a domed outer surface 58 may be every other ridge, or every fourth ridge, or every fifth ridge, and so on. In the embodiment illustrated in FIG. 7C, the outer surface of all of the ridges 52 have a domed outer surface 58. A fabric layer 40 may be adhered to the mat 42 at the rear surface of the valleys 54.

The ridges 52 of the extensions 36 of the mortar collection device face the inner wall structure 14. The dome shaped top outer surface 58 of ridges 52 can accommodate irregularities in the masonry cavity 16. The dome shaped outer surface 58 of the ridges 52 may be compressed against the inner wall 14 to press the fabric layer 40 toward the outer wall 12, inhibiting the mortar from pushing into the cavity 16. The mortar collection device 20, while having an open structure that is relatively rigid and crush resistant, includes extensions 36 formed from a material which the is nonetheless capable of limited flexibility.

Figure 8A:
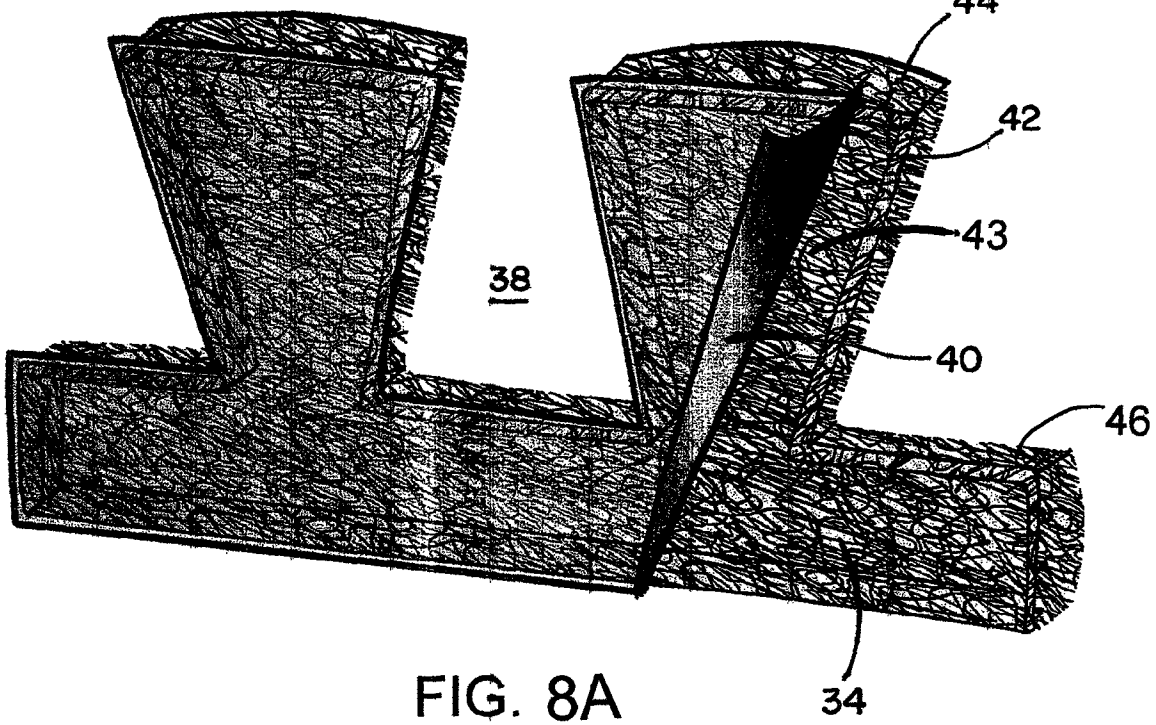
FIG. 8A is a perspective view of a further embodiment of the mortar collection device of the present invention that includes a plurality of extensions, each having a convex contour and a hollow interior.
Figure 8B:
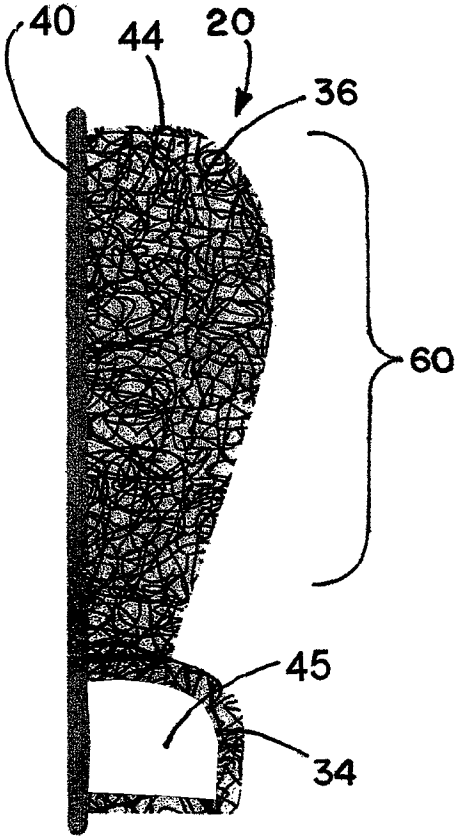
FIG. 8B is a side view of the mortar collection device of FIG. 8A.

Referring to FIGS. 8A and 8B, another embodiment of the mortar collection device is illustrated. In this embodiment, the mortar collection device includes mat 42 with extensions 36 having a convex contour 60. The contour 60 of the extensions 36 forms an upper shelf 44 and tapers near the base 34. The outer surface of the base 34 is curved to form a hollow channel 45, the upper surface of which forms a base shelf 46. In this embodiment, the base 34 and extensions 36 are formed by extruding a thin layer of polymeric monofilaments onto a molding surface having a contoured surface so that when the mortar collection device is removed from the molding surface, the mortar collection device includes a thin "shell" of entangled polymeric monofilaments with an interior hollow 43 that is free of monofilaments. The body of the mortar collection device may have an overall maximum thickness dimension that is substantially the same as the width of the cavity between the inner and outer walls. Referring to FIG. 8B, when the mortar collection device is placed within the cavity 16, the apexes of the convex extension 36 and of the convex base 34 contact the inner wall 14 of the wall cavity. In one embodiment, the mortar collection device 20 has a convex shape in a width direction and is compressible to accommodate wall variations in the masonry cavity of up to 0.5 inch (1.27 cm). The device may be compressible under a load similar to the weight of a 3 inch×3 inch×8 inch brick.

The thickness of the polymer monofilaments of the shell may be about 0.01 inch (0.25 mm) to about 0.125 inch (3.18 mm). In one embodiment, the thickness of the polymer monofilaments is greater than about 0.01 inch (0.25 mm). The thickness of the polymer monofilaments may be less than 0.125 inch (3.18 mm).

In one embodiment, the quantity or thickness of the polymer filaments of the base is greater than the quantity or thickness of the polymer filaments of the extensions. In another embodiment, the quantity or thickness of the polymer filaments of the extensions is greater than the quantity or thickness of the polymer filaments of the base.

In one embodiment, the total thickness of all of the "shelves" present in each extension is between about 0.01 to about 0.5 inch. Thus, the amount of material (filaments) within the cavity is limited. In one embodiment, for example, the total height of the mortar collection device is about 10 inches (25.4 cm), and of that total height, the shelves or horizontal obstructions within the cavity through which moisture flows and air circulates makes up only about 0.25 inch (0.635 cm) thickness.

In one embodiment, the total volume of filaments in each extension is less than 10% based on the total volume of filaments and filament-free space occupied by the extension within the masonry cavity. In one embodiment, the total volume of filaments in the at least one extension is less than 5%, or less than 3% based on the total volume of filaments and filament-free space occupied by the extension within the masonry cavity.

The base 34 and the extensions 36 of the mortar and debris collection device may include a planar peripheral rim 47 for bonding a fabric layer 40 to the device. In one embodiment, the width of the rim is about 0.25 inch (0.635 cm) to about 5.0 inches (12.7 cm).

Figure 9A:
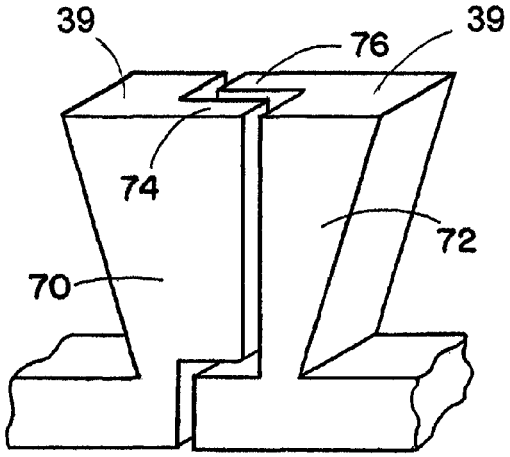
FIG. 9A is a perspective view of an embodiment of the mortar collection device including an interlocking feature.
Figure 9B:
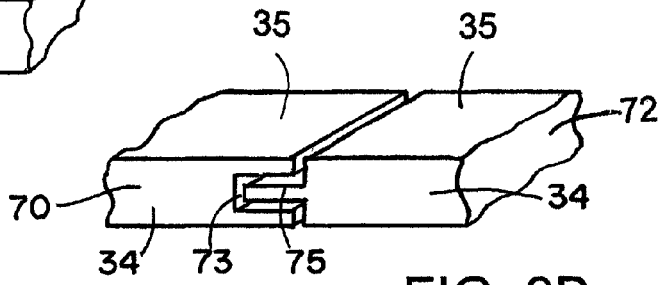
FIG. 9B is a perspective view of another embodiment of the mortar collection device including an interlocking feature in the base portion.

Referring to FIGS. 9A and 9B, the mortar collection device may include an interlocking element to prevent mortar and/or debris from collecting between adjacent devices. In the embodiment illustrated in FIG. 9A, a first mortar collection device 70 includes a forward key 74 at its outer edge and an adjacent second mortar collection device 72 includes a rearward key 76 at its outer edge. When the first mortar collection device 70 is placed within the cavity adjacent the second mortar collection device 72, the forward key 74 aligns with the rearward key 76, thus preventing a gap between the first and second mortar collection device in upper shelf 39.

In the embodiment illustrated in FIG. 9B, a first mortar collection device 70 includes a notch 73 in the base 34 at its outer edge. Adjacent second mortar collection device 72 includes a key 75 projecting from the outer edge of base 34. When the first mortar collection device 70 is placed within the cavity adjacent the second mortar collection device 72, the key 75 of the second mortar collection device is inserted into the notch 73 of the first mortar collection device, thus preventing a gap between the first and second mortar collection devices in lower shelf 35.

Figure 10:
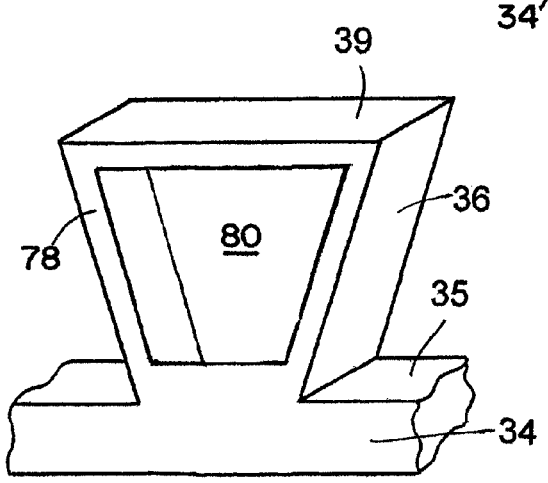
FIG. 10 is a perspective view of an embodiment of the mortar collection device of the present invention wherein the extension includes a keystone shaped frame.

Referring to FIG. 10, in one embodiment, the mortar collection device includes a plurality of extensions wherein each extension 36 comprises a trapezoidal frame 78 having an interior passage 80. The frame 78 and the base 34 are formed from polymer monofilaments that twist and turn randomly between randomly located junctures where adjacent filaments are heat bonded so as to define substantially rigid open-space mat elements that permit moisture to pass readily therethrough. The upper shelf 39 of the frame 78 and the lower shelf 35 of base 34 are capable of catching and supporting sizable mortar droppings and construction debris that fall within the cavity 16. The interior passage 80 may be formed, for example, by die cutting the center of extension 36.

Figure 11:
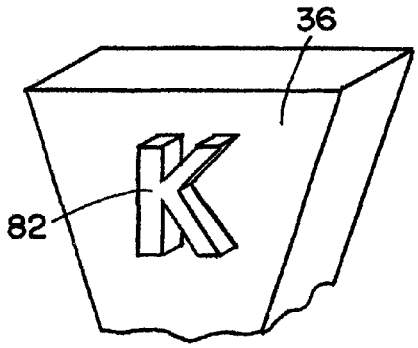
FIG. 11 is a perspective view of an embodiment of the mortar collection device including an identification feature.

Referring to FIG. 11, the mortar collection device may include an identifying element 82 within the extension 36. The identifying element 82 may project from the surface of the extension 36 as illustrated, or may be recessed into the extension 36. The identifying element 82 may include for example, a logo, one or more alphanumeric characters, a design, or a combination thereof.

Figure 12:
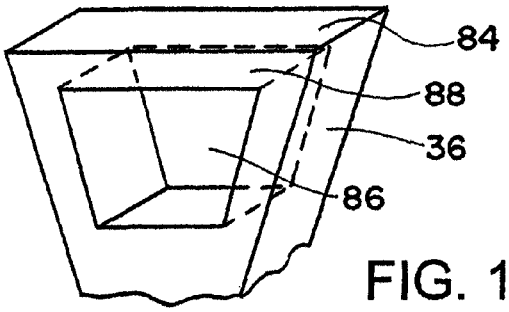
FIG. 12 is a perspective view of an embodiment of the mortar collection device including an extension having a second shelf.

Referring to FIG. 12, in one embodiment the extension 36 of the mortar collection device includes an interior depression 86 that forms an interior secondary shelf 88 to collect mortar and debris. The secondary shelf 88 serves as a backup collection surface to the primary shelf 84 formed on the top surface of the extension 36. The mortar collection device of this embodiment may be formed by extruding a thin layer of polymeric monofilaments onto a molding surface that includes a recess within the extension portion of the molding surface so that when the mortar collection device is removed from the molding surface, each extension 36 includes a depression 86, the top of which creates a secondary shelf 88 below the primary shelf 84.

Figure 13:
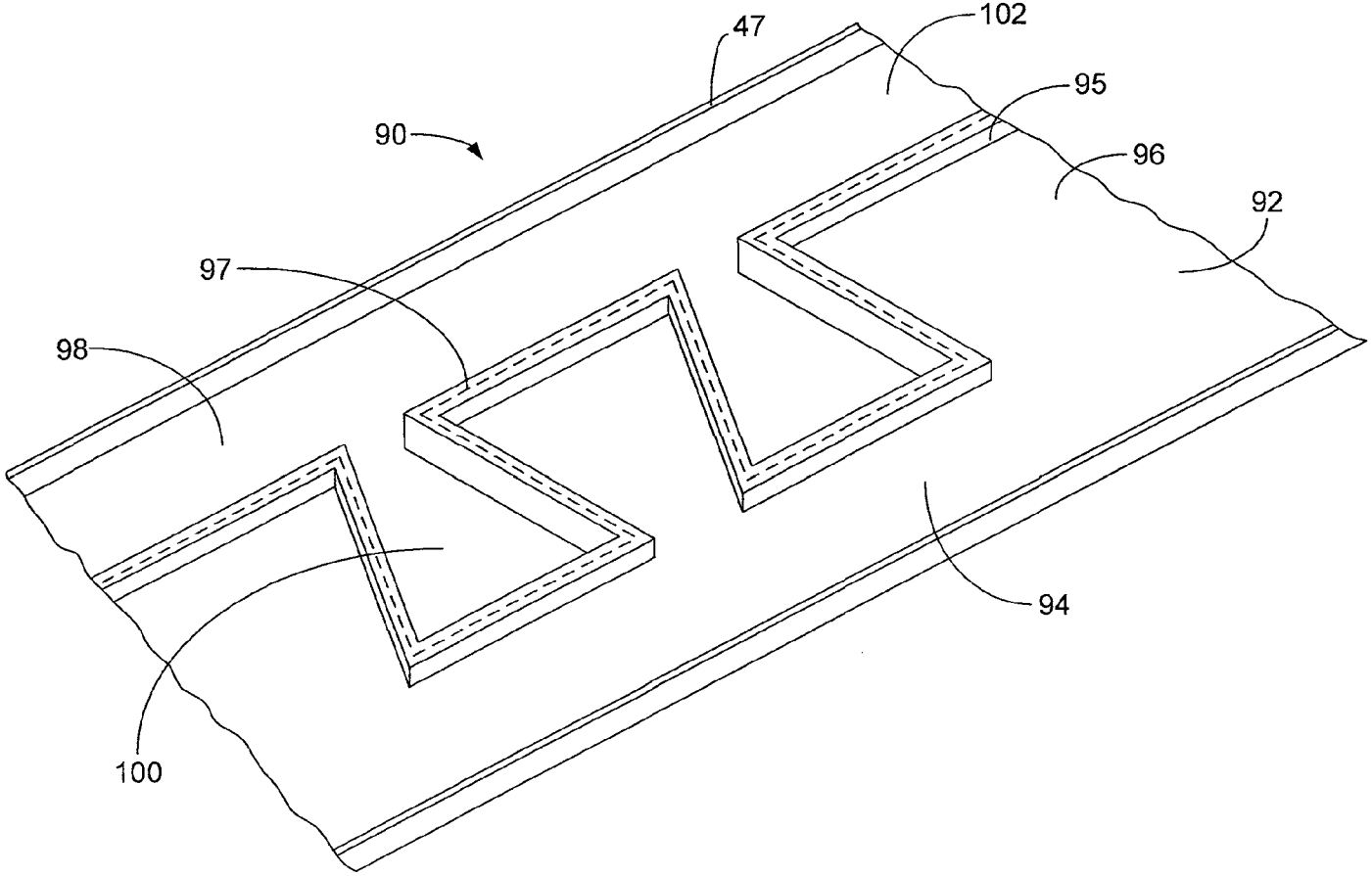
FIG. 13 is a perspective view of a sheet containing two mortar collection devices prior to separation.

Referring to FIG. 13, the mortar collection device may be made by extruding a layer of monofilaments onto a contoured surface to form a sheet 90 of two mortar collection devices, the second device upside down and abutting the first device such that the extensions of the first device are formed between the extensions of the second device. The first mortar collection device 92 is joined to second mortar collection device 98 at raised joint 95. The two mortar collection devices are separated by die cutting the raised joint 95 along line 97 to form first mortar collection device 92 having extensions 94 extending from base 96. The second mortar collection device 98 includes extensions 100 extending from base 102. Each mortar collection device may include a planar peripheral rim 47 to which may be bonded a fabric layer.

The device, without the fabric layer bonded thereto, may be stackable with one or more additional devices to facilitate transport and/or storage of the devices. For example, the base of a first device may nest within the base of a second device positioned below the first device and the extensions may nest within the extensions of the second device.

Figure 14:
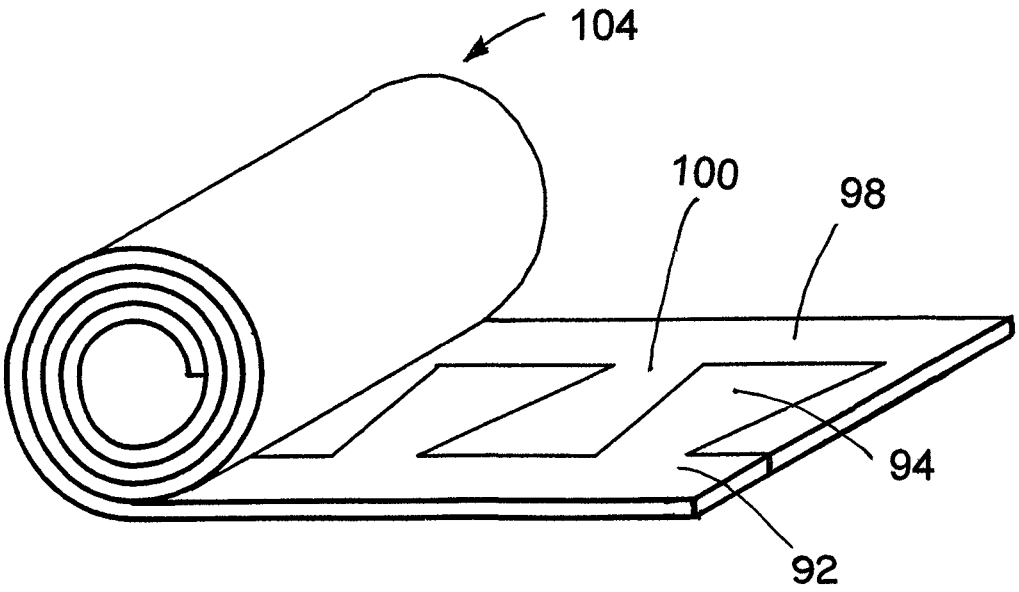
FIG. 14 is a perspective view of a roll of two pieces of the mortar collection device of the present invention.

Referring to FIG. 14, a first mortar collection device 92 may be positioned adjacent to second mortar collection device 98 such that the extensions 94 of the first mortar collection device are inset between the extensions 100 of the second mortar collection device 98 and rolled up into roll 104 to facilitate storage and transportation of the mortar collection devices.

While the invention has been explained in relation to various embodiments, it is to be understood that various modifications thereof will become apparent to those skilled in the art upon reading this specification. Therefore, it is to be understood that the invention provided herein is intended to cover such modifications as may fall within the scope of the appended claims.

The invention claimed is:

1. A mortar and debris collection device for use in a masonry wall assembly having an inner wall and an outer wall, a masonry cavity defined between the walls, and weep vent passages formed through the outer wall, where the weep vent passages open into the cavity for discharge of moisture from the cavity, comprising:

a water permeable body comprising a contoured hollow shell formed of an open space array of polymer filaments that twist and turn between filament intersections where adjacent ones of the filaments are bonded to each other, the contours of the shell defining an interior filament-free hollow having an open back face and a closed front face opposite the back face;

the hollow shell having a base elongated along a linear axis and at least one extension upwardly projecting from the base along the linear axis in a vertical direction, the at least one extension comprising at least one shelf for collecting mortar and debris within the masonry cavity above the weep vent passages.

2. The device of claim 1 wherein the shell includes two or more extensions upwardly projecting from the base.

3. The device of claim 1 wherein the at least one extension further comprises at least two shelves for collecting mortar and debris.

4. The device of claim 1 wherein the at least one extension has an upper edge and comprises a plurality of alternating valleys and ridges extending lengthwise to the upper edge.

5. The device of claim 4 wherein the ridges and valleys extend from the base to the upper edge.

6. The device of claim 4 wherein the ridges and valleys extend from a midway point along the length of the extension to the upper edge.

7. The device of claim 4 wherein at least one of the ridges has a planar surface.

8. The device of claim 4 wherein at least one of the ridges has a dome-shaped surface.

9. The device of claim 1 wherein the base comprises a lower shelf for collecting mortar and debris.

10. The device of claim 1 wherein the at least one extension further comprises a notch having an opening at the uppermost edge and a notch base, the notch base comprising an intermediate shelf for collecting mortar and debris.

11. The device of claim 1 wherein the at least one extension has a keystone shape.

12. The device of claim 11 wherein the shell comprises two or more extensions and adjacent extensions form a trapezoidal shaped channel therebetween.

13. The device of claim 12 wherein the keystone shaped extensions are configured so as to be positionable between the keystone shaped extensions of a second mortar and debris collection device to permit rolling of the device together with the second mortar and debris collection device.

14. The device of claim 1 wherein the device is stackable with one or more additional mortar and debris collection devices to facilitate transport of the devices.

15. The device of claim 1 wherein the shell further comprises a planar periphery rim for bonding a fabric layer to the shell.

16. The device of claim 15 wherein the width of the rim is about 0.25 inch to about 5.0 inches.

17. The device of claim 1 wherein the at least one extension further comprises an identifying element.

18. The device of claim 1 wherein the device has a vertical edge and the vertical edge comprises an engaging member for coupling the device to an adjacent mortar and debris collection device within the masonry cavity.

19. The device of claim 1 wherein the body has a maximum thickness dimension substantially the same as the width of the masonry cavity.

20. The device of claim 1 wherein the quantity or thickness of the polymer filaments of the base is greater than the quantity of thickness of the polymer filaments of the at least one extension.

21. The device of claim 1 wherein the quantity or thickness of the polymer filaments of the at least one extension is greater than the quantity of thickness of the polymer filaments of the base.

22. The device of claim 1 wherein the total thickness of the at least one shelf and any additional shelves, if present, within the at least one extension is between about 0.01 to about 0.5 inch.

23. The device of claim 1 wherein the total volume of filaments in the at least one extension is less than 10% based on the total volume of filaments and filament-free space occupied by the extension within the masonry cavity.

24. The device of claim 1 wherein the total volume of filaments in the at least one extension is less than 5% based on the total volume of filaments and filament-free space occupied by the extension within the masonry cavity.

25. The device of claim 1 wherein the total volume of filaments in the at least one extension is less than 3% based on the total volume of filaments and filament-free space occupied by the extension within the masonry cavity.

26. The device of claim 1 wherein the polymer filaments are made of a material selected from polyolefin, polyamide, polyester, polyvinylhalide, polystyrene, polyvinylester and a mixture of two or more thereof.

27. The device of claim 1 wherein the polymer filaments are made of a material selected from polyethylene, polypropylene, and a mixture thereof.

28. The device of claim 1 wherein the water permeable body further comprises a fabric layer bonded to the shell.

29. The device of claim 28 wherein the fabric layer comprises a plurality of fiberglass strands.

30. The device of claim 1 wherein the filament free hollow is directly below the shelf of the at least one extension.

31. A mortar and debris collection device insertable into lower portions of a cavity defined between outer and inner wall structures of a masonry cavity wall to form a multilevel collector for catching mortar droppings and sizable construction debris at locations spaced apart from where weep vent passages formed through the outer wall structure open into lowermost portions of the cavity, comprising:

a water permeable body comprising a contoured hollow shell formed of an open space array of polymer filaments that twist and turn between filament intersections where adjacent ones of the filaments are bonded to each other, the contours of the shell defining an interior filament-free hollow having an open back face and a closed front face opposite the back face;

the hollow shell having a base elongated along a linear axis and at least one extension upwardly projecting from the base along the linear axis in a vertical direction, the at least one extension comprising at least one shelf for collecting mortar and debris within the masonry cavity above the weep vent passages;

wherein the body permits moisture to pass therethrough as moisture migrates downwardly through the cavity and into the weep vent passages.

* * * * *